US010182278B2

(12) United States Patent
Yanofsky et al.

(10) Patent No.: US 10,182,278 B2
(45) Date of Patent: Jan. 15, 2019

(54) PORTABLE COMPACT BLUETOOTH SPEAKER

(71) Applicant: Pred Technologies USA Inc., La Jolla, CA (US)

(72) Inventors: Peter Yanofsky, La Jolla, CA (US); Adam Fairless, La Jolla, CA (US); Charles Speidel, San Diego, CA (US)

(73) Assignee: Pred Technologies USA Inc., La Jolla, CA (US)

( * ) Notice: Subject to any disclaimer, the term of this patent is extended or adjusted under 35 U.S.C. 154(b) by 0 days.

(21) Appl. No.: 15/620,453

(22) Filed: Jun. 12, 2017

(65) Prior Publication Data

US 2017/0359641 A1 Dec. 14, 2017

Related U.S. Application Data

(60) Provisional application No. 62/348,247, filed on Jun. 10, 2016.

(51) Int. Cl.
*H04R 1/02* (2006.01)

(52) U.S. Cl.
CPC ..... *H04R 1/026* (2013.01); *H04R 1/025* (2013.01); *H04R 2420/07* (2013.01)

(58) Field of Classification Search
CPC ..... H04R 1/026; H04R 1/025; H04R 2420/07
USPC ..... 381/334, 301, 311, 333
See application file for complete search history.

(56) References Cited

U.S. PATENT DOCUMENTS

| | | | | |
|---|---|---|---|---|
| 9,264,791 | B1 * | 2/2016 | Polivy | H04R 1/025 |
| 2016/0058375 | A1 * | 3/2016 | Rothkopf | G06F 1/1643 600/301 |
| 2017/0195763 | A1 * | 7/2017 | Cheney | H04R 1/026 |

* cited by examiner

*Primary Examiner* — Vivian Chin
*Assistant Examiner* — Ammar Hamid
(74) *Attorney, Agent, or Firm* — Keith A. Vogt; Vogt IP

(57) ABSTRACT

A wireless speaker device having a housing including a first magnet and an arm configurable between a straight configuration and a bent configuration. The arm is attached to the housing on one end and has an opposing end having a second magnet. The arm is bendable to allow the magnets to engage another to attach the device to clothing and other items.

20 Claims, 3 Drawing Sheets

PORTABLE COMPACT BLUETOOTH SPEAKER

RELATED APPLICATIONS

This application claims the benefit of U.S. Provisional Application No. 62/348,247 filed Jun. 10, 2016 and herein incorporated by reference.

STATEMENT REGARDING FEDERALLY SPONSORED RESEARCH & DEVELOPMENT

Not applicable.

INCORPORATION BY REFERENCE OF MATERIAL SUBMITTED ON A COMPACT DISC

Not applicable.

BACKGROUND OF THE INVENTION

The present invention relates to a portable Bluetooth speaker. In particular, this invention relates to a portable Bluetooth speaker that can communicate with a Bluetooth cell phone or other Bluetooth enabled device and can operate in a speaker mode without the user having to hold the receiver or speaker.

BRIEF SUMMARY OF THE INVENTION

In one embodiment, the present invention provides a portable Bluetooth speaker. It can communicate with a Bluetooth communication device in a wireless way, and can be operated in a speaker mode without the user having to hold the receiver or speaker.

In other embodiments, the present invention provides a portable Bluetooth speaker that may be releasably attached to a wide variety of objects and clothing items.

In other embodiments, the present invention provides a portable Bluetooth speaker that has an attachment mechanism that is reconfigurable to allow the device to be releasably attached to a wide variety of objects and clothing items.

In one preferred embodiment, the present invention provides a hands-free smart speaker that is Bluetooth enabled. The device connects via Bluetooth to phones to allow "hands free" calls. In addition, the speaker may connect via Bluetooth to a computer, tablet or other Bluetooth enabled device. This permits a user to be able to conduct "hands free" phone calls allowing for the hands to be used elsewhere in many day to day situations.

In a preferred embodiment, the device is reconfigurable to connect to garments and clothing by the use of a magnetic clasp that can be situated near the collar line for easy participation in calls. It can also be attached to other objects including metallic objects such as desk lamps.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

In the drawings, which are not necessarily drawn to scale, like numerals may describe substantially similar components throughout the several views. Like numerals having different letter suffixes may represent different instances of substantially similar components. The drawings illustrate generally, by way of example, but not by way of limitation, a detailed description of certain embodiments discussed in the present document.

DETAILED DESCRIPTION OF THE INVENTION

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a representative basis for teaching one skilled in the art to variously employ the present invention in virtually any appropriately detailed method, structure or system. Further, the terms and phrases used herein are not intended to be limiting, but rather to provide an understandable description of the invention.

Figure 1:
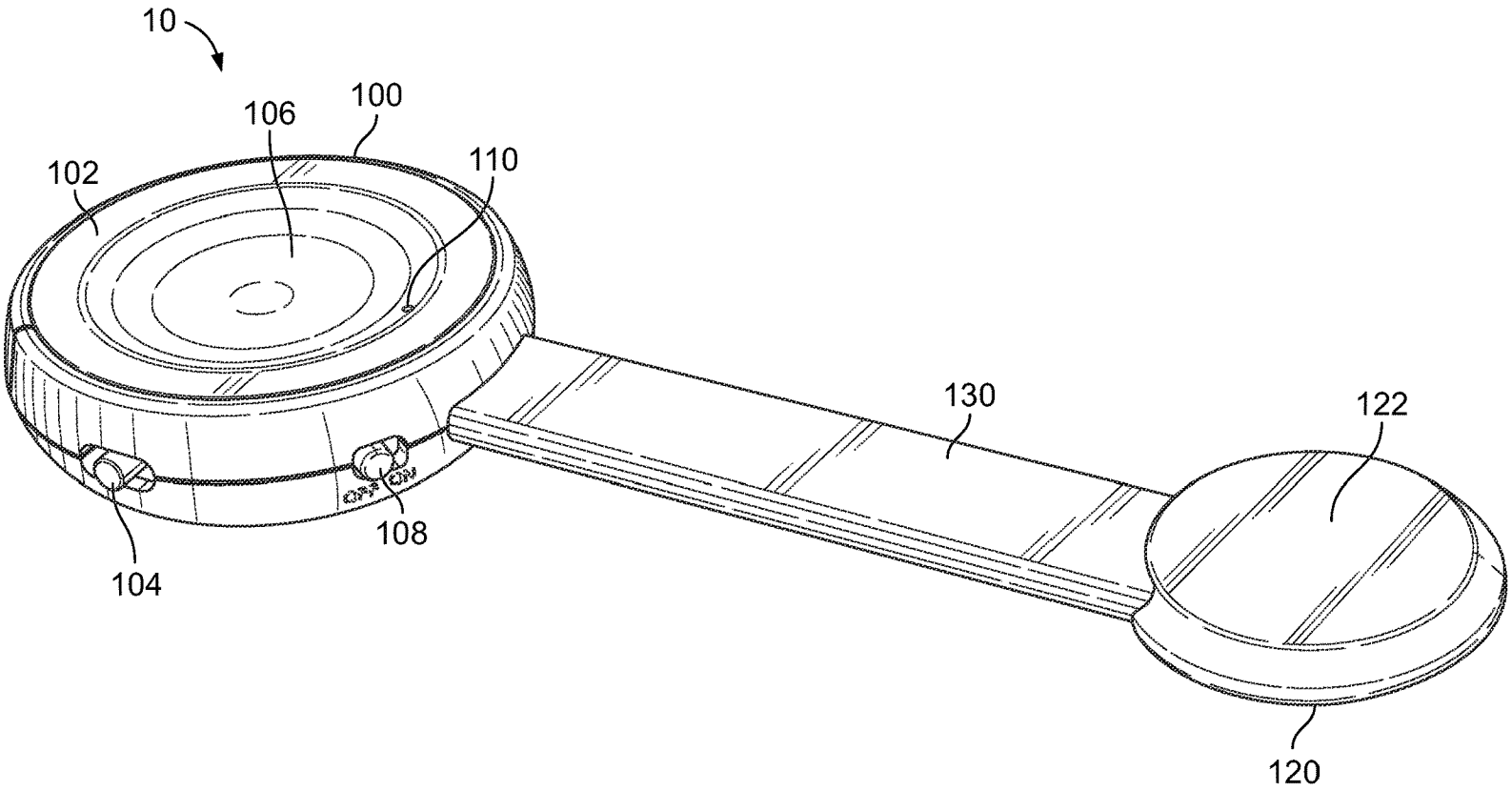
FIG. 1 is a perspective view of an embodiment of the present invention.
Figure 2:
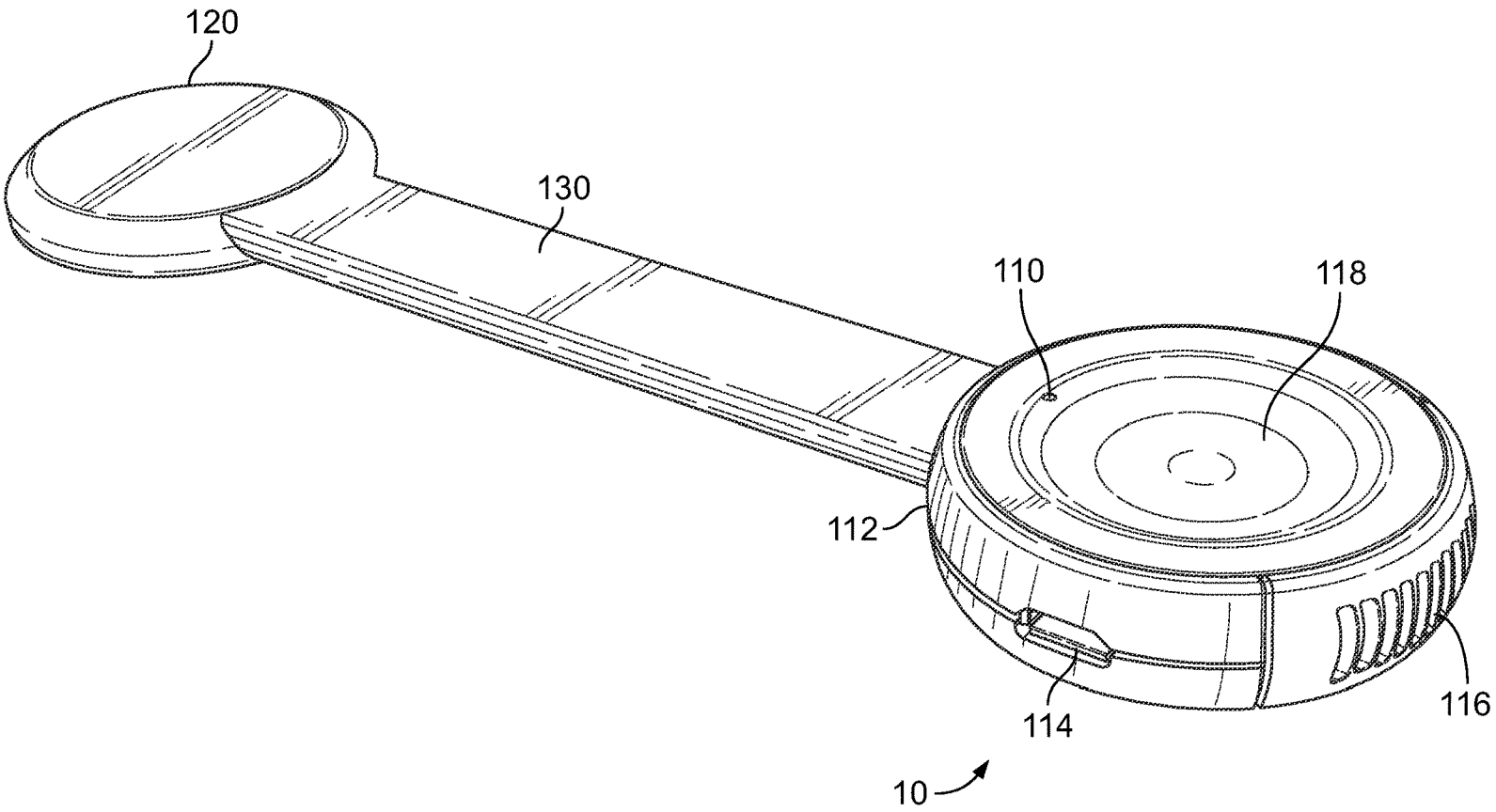
FIG. 2 is a second perspective view of an embodiment of the present invention.
Figure 3:
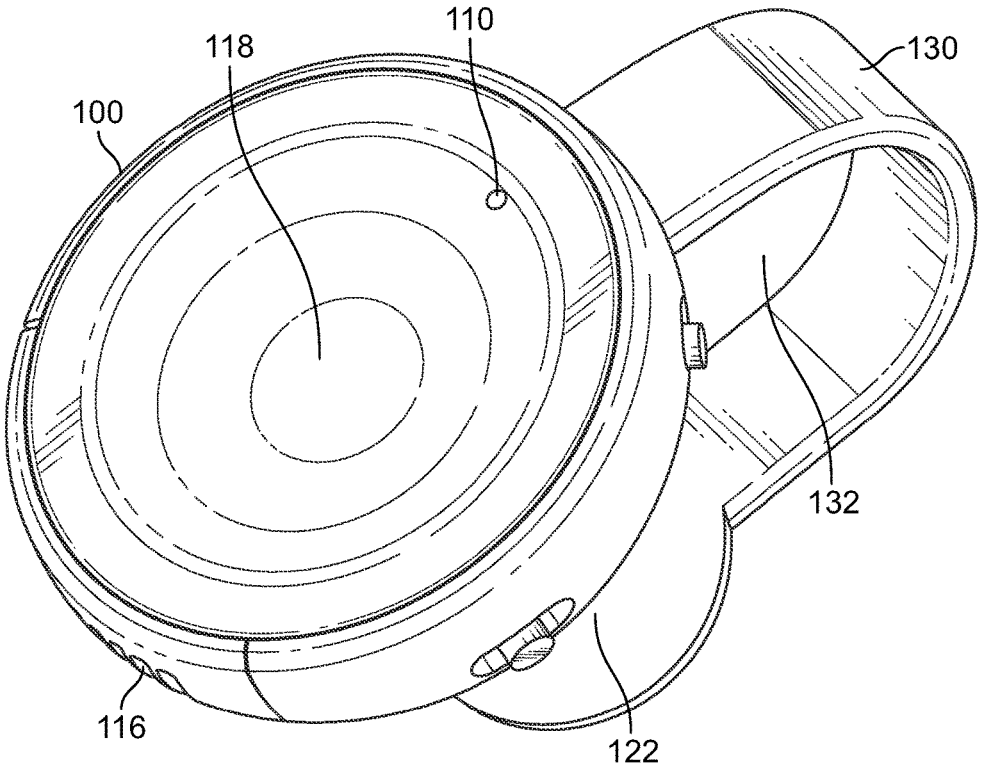
FIG. 3 illustrates how an embodiment of the present invention may be reconfigurable to attach to a wide variety of objects and clothing items.

As shown in FIGS. 1-3, in a preferred embodiment, the present invention provides a hands free smart communication system 10. System 10 includes a housing 100 in which a small speaker and microphone (not shown) are located. Also included is a tact switch 118 located at a first surface of the housing and an opposingly located from second surface where underside magnet 106 may be located. A sidewall 150 separates the first and second surfaces.

Housing 100 may also include rubber cover 102, volume control 104, power switch 108 and LED status indicator light 110. Also included are microphone aperture 112, micro USB connector 114, speaker grill 116 and rubber cover 102 which may protect tact switch 118.

In use, device 10 is reconfigurable to permit attachment to a wide variety of clothing items and objects. The attachment mechanism includes magnet 122 that is connected to housing 100 by flexible arm/strap 130 which may be made of silicone. As shown, strap 130 may be attached to housing 100 at a midpoint.

In a preferred embodiment, housing 100 may be 43 mm in diameter and 12 mm in depth and comprise an outer casing made from a hard plastic. In addition, strap 130 may be 80 mm in length with a magnet 122 encased in the end.

In use, magnet 122 attaches to underside magnet 106. This forms a hoop or opening 132 as shown in FIG. 3. Magnets 106 and 122 connect together through clothing forming a grip on the garment. In addition, device 10 has an ergonomic layout for interface with volume, power and charging.

In other embodiments, the present invention provides a wireless speaker device having a housing including a first magnet and an arm configurable between a straight configuration and a bent configuration. The arm is attached to the housing on one end and has an opposing end having a second magnet. The arm is bendable to allow the magnets to engage another to attach the device to clothing and other items.

In yet other embodiments, the first and second magnets are attached to one another to form an opening. Clothing may be locate in the opening. For example, a shirt edge or collar may be located in the opening which allows the device to be more securely attached. To assist in the use of the device, the first magnet may be larger than the second magnet. The housing may also be circular and the second magnet may be circular, with the second magnet being smaller than the housing.

To further make the device easier to use, the length of the arm should greater than the diameter of the housing. The length of the arm may be at least forty-percent greater than the diameter of the housing.

To avoid clothing from interfering with the speaker, the speaker grill may be located in the sidewall and opposingly located from where the arm attaches to the housing. The rubber covers avoid damaging the clothing and other objects the device may be attached to as well as protecting the device itself.

In other embodiments, the present invention provides a method of attaching a wireless speaker device to an object comprising the step of: providing a housing including a first magnet, a bendable arm that is attached to the housing on one end and having an opposing end having a second magnet; and one or more of the magnets are used to connect the device to an object.

In other embodiments, the present invention provides a method of attaching a wireless speaker device to an article of clothing comprising the step of: providing a housing including a first magnet, a bendable arm attached to the housing on one end and having an opposing end having a second magnet; and bending the arm to form an opening adapted to receive a portion of the clothing so that when the magnets engage one another, the device is attached the item of clothing.

In other embodiments, the present invention provides a portable compact Bluetooth speaker, which may be a Smart wearable assistant. For this embodiment, the device may be configured to answer phone calls (without having to touch your mobile phone), connect to third-party voice controlled applications such as Siri/Google Now/Cortana (any smart phone personnel assistant) without the need to touch the device, play music, and allow a user to trigger a phone to take a picture remotely (shutter function).

While the foregoing written description enables one of ordinary skill to make and use what is considered presently to be the best mode thereof, those of ordinary skill will understand and appreciate the existence of variations, combinations, and equivalents of the specific embodiment, method, and examples herein. The disclosure should therefore not be limited by the above described embodiments, methods, and examples, but by all embodiments and methods within the scope and spirit of the disclosure.

What is claimed is:

1. A wireless device comprising:

a circular housing including a first magnet;

an arm configurable between a straight configuration and a bent configuration;

said arm attached to said housing on one end and having an opposing end having a circular second magnet;

a first surface and an opposingly located second surface, said first magnet located at said first surface and a switch located at said second surface;

a sidewall between said first surface and said second surface, a speaker located in said circular housing and a speaker grill located in said sidewall and opposingly located from where said arm attaches to said housing; and when said first and second magnets are attached to one another, said arm forms an opening.

2. The device of claim 1 wherein said first magnet is larger than said second magnet.

3. The device of claim 1 wherein said arm is 83 mm long.

4. The device of claim 1 wherein said housing is circular.

5. The device of claim 1 wherein the length of said arm is greater than the length of said housing.

6. The device of claim 1 wherein the length of said arm is at least forty-percent greater than the diameter of said housing.

7. The device of claim 1 wherein said arm is made of silicone.

8. The device of claim 1 wherein the length of said arm is greater than the diameter of said housing.

9. The device of claim 1 wherein said arm is attached at the midpoint of said sidewall.

10. The device of claim 1 wherein said surfaces include rubber covers located on the outer circumference of said housing and said second magnet.

11. The device of claim 1 wherein further including a volume control and power switch, said volume control and said power switch located at said sidewall.

12. The device of claim 1 further including an LED status indicator light located at said first surface.

13. The device of claim 1 further including an LED status indicator light located at said second surface.

14. The device of claim 1 further including an LED status indicator light located at said first surface and said second surface.

15. A wireless device comprising:

a circular housing including a first magnet;

an arm configurable between a straight configuration and a bent configuration;

said arm attached to said housing on one end and having an opposing end having a circular second magnet;

said first magnet is larger than said second magnet;

a first surface and an opposingly located second surface, said first magnet located at said first surface and a switch located at said second surface;

a sidewall between said first surface and said second surface, a speaker located in said circular housing and a speaker grill located in said sidewall and opposingly located from where said arm attaches to said housing; and when said first and second magnets are attached to one another, said arm forms an opening.

16. The device of claim 15 wherein said arm is attached at the midpoint of said sidewall.

17. The device of claim 15 wherein the length of said arm is greater than the diameter of said housing.

18. A wireless device comprising: a circular housing including a first magnet; an arm configurable between a straight configuration and a bent configuration; said arm attached to said housing on one end and having an opposing end having a circular second magnet; the length of said arm is greater than the length of said housing; a first surface and an opposingly located second surface, said first magnet located at said first surface and a switch located at said second surface; a sidewall between said first surface and said second surface, a speaker located in said circular housing and a speaker grill located in said sidewall and opposingly located from where said arm attaches to said housing; and when said first and second magnets are attached to one another, said arm forms an opening.

19. The device of claim 18 wherein said arm is attached at the midpoint of said sidewall.

20. The device of claim 18 wherein said surfaces include rubber covers located on the outer circumference of said housing and said second magnet.

* * * * *